US006324356B1

(12) United States Patent
Inoue

(10) Patent No.: US 6,324,356 B1
(45) Date of Patent: Nov. 27, 2001

(54) TONER SAVE METHOD AND SYSTEM FOR IMAGE DUPLICATING DEVICES

(75) Inventor: Yoshiya Inoue, Tokyo (JP)

(73) Assignee: Ricoh Company, LTD, Tokyo (JP)

( * ) Notice: Subject to any disclaimer, the term of this patent is extended or adjusted under 35 U.S.C. 154(b) by 0 days.

(21) Appl. No.: 09/703,310

(22) Filed: Nov. 1, 2000

(30) Foreign Application Priority Data

Nov. 5, 1999 (JP) ..... 11-314871
Jun. 21, 2000 (JP) ..... 12-186696

(51) Int. Cl.[7] ..... G03G 15/01
(52) U.S. Cl. ..... 399/39; 358/1.9
(58) Field of Search ..... 399/27, 39, 40, 399/53, 55; 358/1.9, 298, 300, 455, 456, 458, 461

(56) References Cited

U.S. PATENT DOCUMENTS 5,083,160 * 1/1992 Suzuki et al. ..... 399/39
5,343,282 * 8/1994 Kazaki et al. ..... 399/39
5,355,440 * 10/1994 Sayanagi et al. ..... 358/1.9
5,722,003 * 2/1998 Suzuki et al. ..... 399/39
5,729,270 * 3/1998 Wright et al. ..... 358/298 X
5,737,665 * 4/1998 Sugiyama et al. ..... 399/39

FOREIGN PATENT DOCUMENTS 63-106763 * 5/1988 (JP) .
8-137169 * 5/1996 (JP) .

* cited by examiner

*Primary Examiner*—Sandra Brase
(74) *Attorney, Agent, or Firm*—Knoble & Yoshida, LLC

(57) ABSTRACT

The color toner application level is flexibly adjusted to save the toner consumption by lowering the developing bias voltage value while color balance is maintained by adjusting gamma characteristics. The toner save mode is invoked based upon the detection of substantially unequal toner consumption among color components.

14 Claims, 5 Drawing Sheets

TONER SAVE METHOD AND SYSTEM FOR IMAGE DUPLICATING DEVICES

FIELD OF THE INVENTION

The current invention is generally related to toner saving in image reproduction devices such as printers, copiers, facsimile machines and any combinations thereof, and more particularly related to maintaining color balance in the reduced toner application.

BACKGROUND OF THE INVENTION

In order to save the consumption of toner in color image duplicating devices such as printers, copiers, facsimile machines and any combinations thereof, the prior art color image duplicating devices utilize less than a predetermined amount of toner and generates color images at a low printing density in a toner save mode. In general, there are two kinds of approaches to save toner in image duplicating devices. According to one prior art toner saving method, image data is simplified or reduced. In another prior art toner saving method, a bias voltage for transferring toner onto a static image on a photoreceptor drum is reduced. The first prior art toner saving method loses resolution in a generated image, and a desired image is hardly obtained.

With respect to the second approach, color balance cannot be properly maintained at a bias voltage value that is lower than a predetermined optimal value for generating a desirable color image. Color toner generally includes a predetermined number of color components such as cyan (C), magenta (M) and yellow (Y), and these color components are layered to yield desirable colors. By reducing a bias voltage value for transferring, the original color balance is distorted since these color components of the toner are not equally or proportionately affected. Subsequently, an image generated at a low printing density is also distorted for human color perception. For example, a color toner application ratio among C, M and Y is 50:50:50 at a predetermined optimal bias voltage level. When the bias voltage is reduced, the color toner application ratio is altered to be 60:40:40. The change in the color toner application ratio is also affected by certain characteristics of toner and or a developing device. In the above example, since the C application percentage has increased prior to the reduction of the bias voltage, an image appears to be bluish in color, and no desired color is obtained in the image.

The above described second toner saving method needs to maintain color balance in an image generated at a reduced bias voltage value. Furthermore, it is also desirable to practice the toner saving mode based upon actual usage of toner in the image duplicating devices so that a tone cartridge lasts longer.

SUMMARY OF THE INVENTION

In order to solve the above and other problems, according to a first aspect of the current invention, a method of saving toner in image duplicating devices, toner having color components, including: selecting a reduced toner application level that is below a predetermined application level, the predetermined application level including information on a ratio of application levels of the toner color components, the ratio defining a toner application level ratio; determining a reduced toner application level ratio according to the selected reduced toner application level; adjusting the reduced toner application level ratio; and applying the toner based upon the adjusted toner application level ratio so as to generate a desired image maintain a consistent appearance of color image.

According to a second aspect of the current invention, a system for saving toner in image duplicating devices, toner having color components, including: an input unit for selecting a reduced toner application level that is below a predetermined application level, the predetermined application level including information on a ratio of application levels of the toner color components, the ratio defining a toner application level ratio; a processing unit connected to the input unit for determining a reduced toner application level ratio according to the selected reduced toner application level, the processing unit adjusting the reduced toner application level ratio; and an image generation unit connected to the processing unit for applying the toner based upon the adjusted toner application level ratio so as to generate a desired image maintain a consistent appearance of color image.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
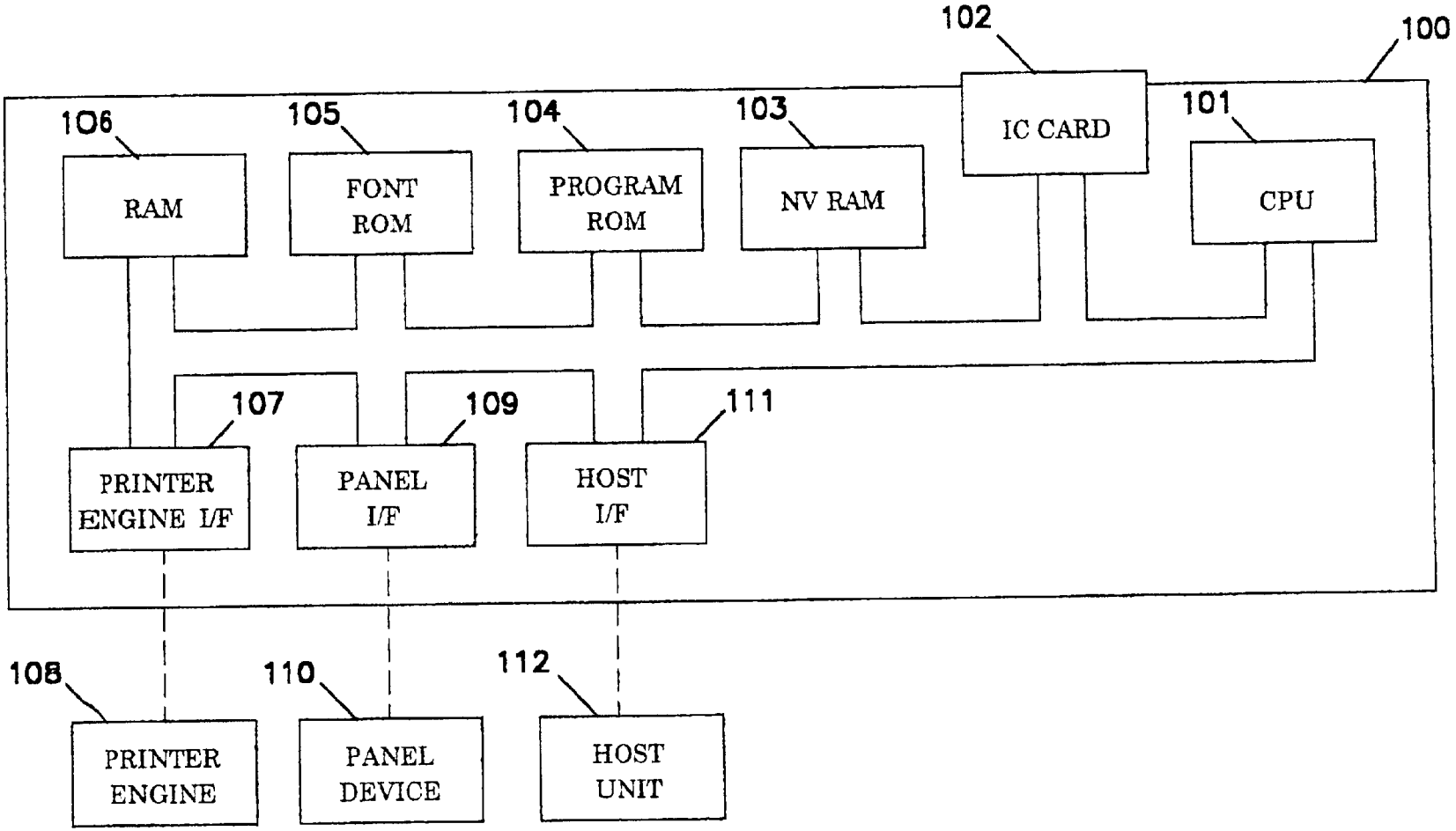
FIG. 1 is a block diagram illustrating a first preferred embodiment of the image duplicating device according to the current invention.

Referring now to the drawings, wherein like reference numerals designate corresponding structures throughout the views, and referring in particular to FIG. 1, a block diagram illustrates a first preferred embodiment of the image duplicating device according to the current invention. The first preferred embodiment includes a controller 100 for generating commands to control the operation of the image duplicating device, a printer engine 108 for generating a desired image based upon print data and in response to the above commands and a panel device 110 for providing an input/output function for interfacing with a user. For example, the panel device 110 accepts an input command from the user or displays the print status in response to the input command. The controller is further connected to a host unit 112 for providing an additional input to the image duplicating device. For example, the host unit 112 includes a computer on the network. The controller 100 processes the above described input commands based upon a predetermined application program and or other software that is stored in the controller 100. One of the commands specifies a toner saving mode while another command maintains color balance during the toner saving mode.

Still referring to FIG. 1, the controller 100 further includes a set of memories, a central processing unit or CPU 101 and a set of interface units. The memories include a random access memory RAM unit 106 for serving as a temporary memory for the CPU 101, a font read-only memory ROM unit 105 for storing fonts or pattern data, a program ROM unit 104 for storing a control program that controls the controller 100, a non-volatile RAM unit 103 for storing print conditions or commands from the panel device 110 and or the host unit 112 and an IC card unit 102 for storing font data and or various programs. The RAM unit 106 also serves as an input data buffer, a print page buffer and a download font buffer. The interface units interface the control unit 100 with other units and include a printer engine interface unit 107 for interfacing with the printer engine 108, a panel interface unit 109 for interfacing with an operator via the panel device 110 and a host interface unit 111 for interfacing with the host unit 112. The host interface unit 111 is implemented in a standard such as RS232C, centro I/F, Ether Net and Local Talk. Each of these memory units 102 through 106 and the interface units 107, 109 and 111 is connected to the CPU 101 via bus.

To implement a toner saving mode in the above described controller 100, a developing bias voltage value is reduced from a predetermined normal developing bias voltage value. A user via the panel device 110 or the host unit 112 specifies the toner saving mode, and the controller 100 generates a corresponding command to the printer engine 107. The command includes a reduced developing bias voltage value that is lower than the normal or regular developing bias voltage value. A plurality of the reduced developing bias voltage values is stored in either in the NVRAM 103 or the RAM 106, and one of these values is selected at the command generation time. The selected reduced developing bias voltage value along with print data is sent to the printer engine 108 through the printer engine interface unit 107. Upon receiving the reduced bias value, the printer engine 108 sets its bias voltage at the reduced value and generates an image by applying an image-forming medium such as toner onto an image-carrying medium such as paper based upon the reduced bias voltage.

As implied above, in alternative embodiments, a range of reduced developing bias voltage values is stored in one of the above described memory storage units for graded toner saving modes. Each of these graded saving modes saves a different amount or relative amount of toner. For example, assuming that the normal printing is accomplished at level 10, during the toner saving mode, if a user specifies a toner saving value of 6, a corresponding reduced developing bias voltage value is selected to generate an image using approximately 60% of toner that is used for normal printing. Similarly, in lieu of an arbitrary range of numbers, the percentage is used to specify a reduced developing bias voltage value. In other words, if 100% specifies the use of a predetermined normal toner application, 60% specifies a reduced developing bias voltage that results in approximately 60% of the normal toner application.

Color balance is corrected to minimize color distortion in an output image when the developing bias voltage is altered according to the current invention. Color balance is not generally maintained when the developing bias voltage is lowered to save toner. Based upon predetermined gamma characteristic values, the color balance is corrected to achieve a target value that is as close as possible to one of the predetermined gamma characteristic values. For each color component, gamma corrected values or graded values are generated based upon graded patterns that are obtained after gamma-correcting the basic pattern. The graded values are compared to that the target values that was generated by a basic pattern so as to determine a gamma correction value. The selected gamma correction value for each color component is saved for later application. The saved gamma correction values are set at the printer engine 108 via a command issued by the panel device 110 or the host unit 112 when the printer engine is selected to operate at a corresponding toner save mode.

Pairs of the gamma correction values and the corresponding developing bias voltage value are generally stored in the RAM 106, but they can be more permanently stored in the NVARAM 103. Upon printing, based upon a normal toner consumption mode or a toner save mode, the controller 100 reads a corresponding pair of the gamma correction value and the developing bias voltage value from the memory storage units 106 or 103 and sets the selected values in the printer engine 108. Thus, the printer engine 108 is able to substantially maintain color balance under the toner save mode.

One exemplary color balance adjustment is illustrated as follows: It is assumed that the toner application level ratio among the color components CMY is 18:24:30 during a normal toner application mode and that color balance is maintained. Further assuming in a toner save mode that the developing bias voltage is lowered to 50% of the above normal toner application mode, the reduced toner application level ratio has become 10:12:14. Since the reduced toner application level ratio does not maintain the same ratio as the normal toner application level ratio, an output image under the toner save mode fails to maintain color balance. To correct the color balance in the output image, the reduced toner application level ratio 10:12:14 is to be corrected to 9:12:15 at the 50% developing bias voltage. In other words, the gamma correction of the C component is adjusted to generate slightly weaker toner application at 9 while the gamma correction of the Y component is adjusted to generate a slightly stronger toner application at 15. Thus, the color balance is restored.

Another exemplary color balance adjustment is that It is assumed that the toner application level ratio among the color components CMY is 24:32:38 during a normal toner application mode and that color balance is maintained. Further assuming in a toner save mode that the developing bias voltage is lowered to 50% of the above normal toner application mode, the reduced toner application level ratio has become 12:16:19. Although the normal toner application level ratio does not have the 3:4:5 ratio, it is assumed that this ratio provides optimal color balance. Consequently, an output image under the toner save mode fails to maintain color balance. To correct the color balance in the output image, the reduced toner application level ratio 12:16:19 is to be corrected to 12:16:20 at the 50% developing bias voltage. In other words, the gamma correction of the Y component is adjusted to generate slightly stronger toner application at 20. However, unfortunately, the Y toner consumption exceeds the desired 50% level. To solve this problem, the developing bias voltage is further lowered so that the Y toner application level is lowered to a next graded level of 15. At this developing bias voltage, the reduced toner application level ratio becomes 10:13:15. To correct the color balance in the output image, the reduced toner application level ratio 10:13:15 is to be corrected to 9:12:15 at the current developing bias voltage. In other words, the gamma correction of the M component is adjusted to generate slightly weaker toner application at 12. Thus, the color balance is restored at less than 50% toner application level.

Figure 2:
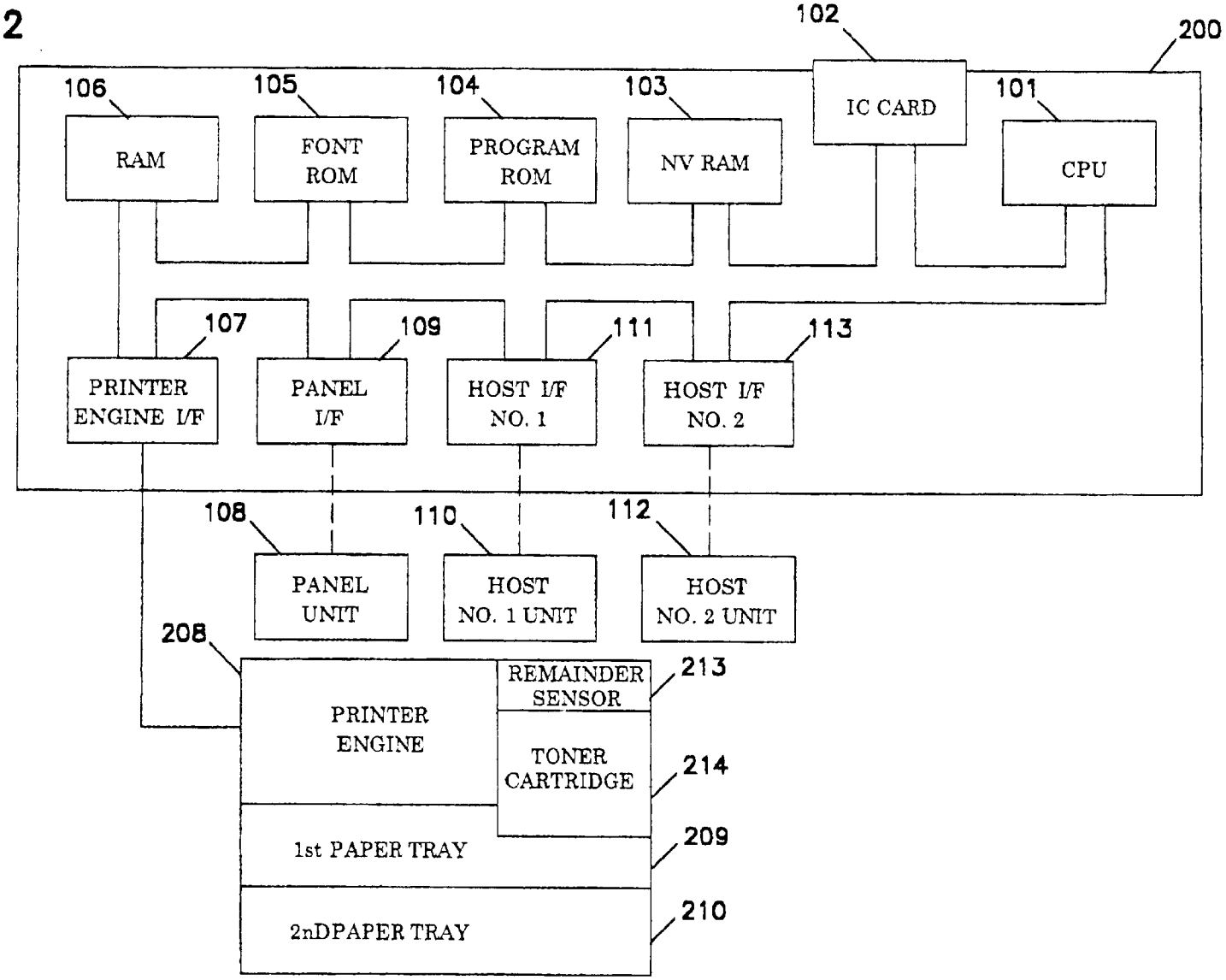
FIG. 2 is a block diagram illustrating a second preferred embodiment of the image duplicating device according to the current invention.

Now referring to FIG. 2, a block diagram illustrates a second preferred embodiment of the image duplicating device according to the current invention. The second preferred embodiment includes a controller 200 for generating commands to control the operation of the image duplicating device, a printer engine 208 for generating a desired image based upon print data and in response to the above commands and a panel device 110 for providing an input/output function for interfacing with a user. For example, the panel device 110 accepts an input command from the user or displays the print status in response to the input command. The controller 200 is further connected to a first host unit 112 and a second host unit 212 for providing an additional input to the image duplicating device. For example, the host units 112 and 212 include a computer on the network. The controller 200 processes the above described input commands based upon a predetermined application program and or other software that is stored in the controller 200. One of the commands specifies a toner saving mode while another command maintains color balance during the toner saving mode.

Still referring to FIG. 2, the controller 200 in the second preferred embodiment includes the elements that have been described with respect to the first preferred embodiment as illustrated in FIG. 2. In addition to those elements, the second preferred embodiment further includes a second host unit interface 113 for the second host unit 212. Furthermore, the print engine unit 208 includes a printer engine, a first and second paper trays 209, 210, a toner cartridge 214 as well as a toner cartridge sensor 213 for detecting a remaining amount of toner in the toner cartridge 214. The toner cartridge 214 further includes separate compartments for storing color components such as CMYK toner. Similarly, the toner cartridge sensor 213 includes separate detectors for each color component and sends the information indicative of the remaining toner amount to the controller 200 via the engine interface unit 107. The controller 200 also determines information indicative of an amount of toner for each CMY color components to be applied to generate a desired image based upon a number of dots in the corresponding bit map stored in the RAM 106. Furthermore, the CPU 101 determines whether or not toner is equally used among the CMY color components based upon the information from the toner cartridge sensor 213. For example, if one of the color components consumes equal to or more than 60% of the total toner consumption, the CPU 101 determines that toner is not equally used among the CMY color components. To further illustrate the above example, suppose the CMY consumption ratio is 20:20:60, since the Y consumption is 60%, the CPU 101 determines the unequal toner consumption.

In one implementation of the second preferred embodiment according to the current invention, when the CPU 101 determines that the toner is not equally used, the controller 200 automatically invokes a predetermined toner save mode for saving toner and indicates that the printer engine is operating under the predetermined toner save mode. In another implementation, the panel unit 110 displays to an operator that the toner is unequally used among the CMY color components, and the operator is able to select one from predetermined toner save modes that have been stored in the RAM 106 or the NVRAM 103. In either implementation, the controller 200 sends print data and the selected information including the corresponding developing bias voltage value to the printer engine 208 via the engine interface unit 107. The printer engine 208 performs printing at the selected developing bias voltage value.

As described before with respect to the first preferred embodiment, the second preferred embodiment also performs the color balance adjustment. Although the color balance adjustment is similar or substantially the same as the one described above, it differs in that the color balance is performed based upon the information on toner application. In the following, an optimal toner application level ratio for the CMY color components is also assumed to be 18:24:30 or 3:4:5 to obtain color balance in an output image. Based upon the above assumption, when the controller 200 detects the 20:20:40 CMY toner consumption ratio, the controller 200 interprets the consumption ratio to mean that the Y toner consumes twice as much as the C or M toner. The controller 200 sets the developing bias voltage in the print engine 208 at a value that causes the Y toner to be consumed at approximately one half of the present Y toner consumption level. Furthermore, in order to optimize color balance in an output image, the CMY toner application level ratio is adjusted to be 9:12:15 by correcting the respective gamma characteristic so as to maintain color balance.

Figure 3:
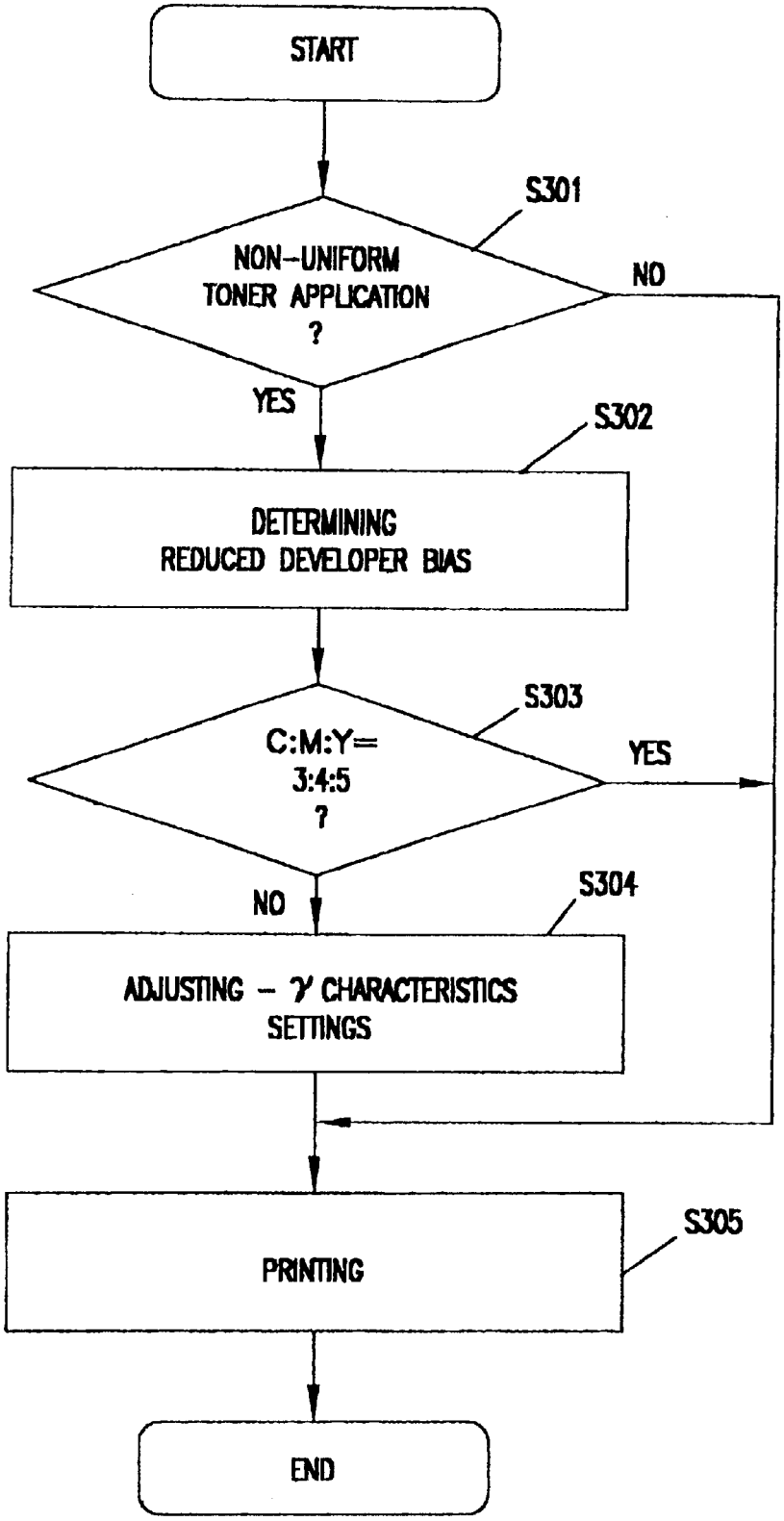
FIG. 3 is a flow chart illustrating steps or acts involved in a first preferred process of printing according to the current invention.

Now referring to FIG. 3, a flow chart illustrates steps or acts involved in a first preferred process of printing according to the current invention. The first preferred process will be also described with respect to tasks performed by the elements in the second preferred embodiment. Based upon the bit-map image data of a desired image in the RAM 106, the controller 200 determines whether or not an amount of toner to be applied is substantially equal among the CMY color components in generating the desired image in step S301. When it is determined that the amounts are not substantially unequal, the first preferred process proceeds to a step S305, where the print engine 208 prints the image data and the preferred process terminates processing. On the other hand, when it is determined that the amounts are substantially unequal, the first preferred process proceeds to a step S302, where a developing bias voltage of the print engine 208 is lowered to enter a save mode. At the reduced developing bias voltage, it is determined in step S303 whether or not a predetermined toner application level ratio will be maintained so that color balance is achieved in the output image. In this implementation of the preferred process, the predetermined toner application level ratio is 3:4:5 among the CMY color components. If the toner application level ratio is maintained, the preferred process proceeds to the printing process at the step S305. In case the toner application level ratio is not the predetermined ratio, in a step S304, a gamma characteristics of a corresponding color component is adjusted to achieve the predetermined ratio before proceeding to the step S305. As a result of the above preferred process, color balance is substantially maintained even at the reduced toner consumption level that is specified by a lowered developing bias voltage.

Figure 4:
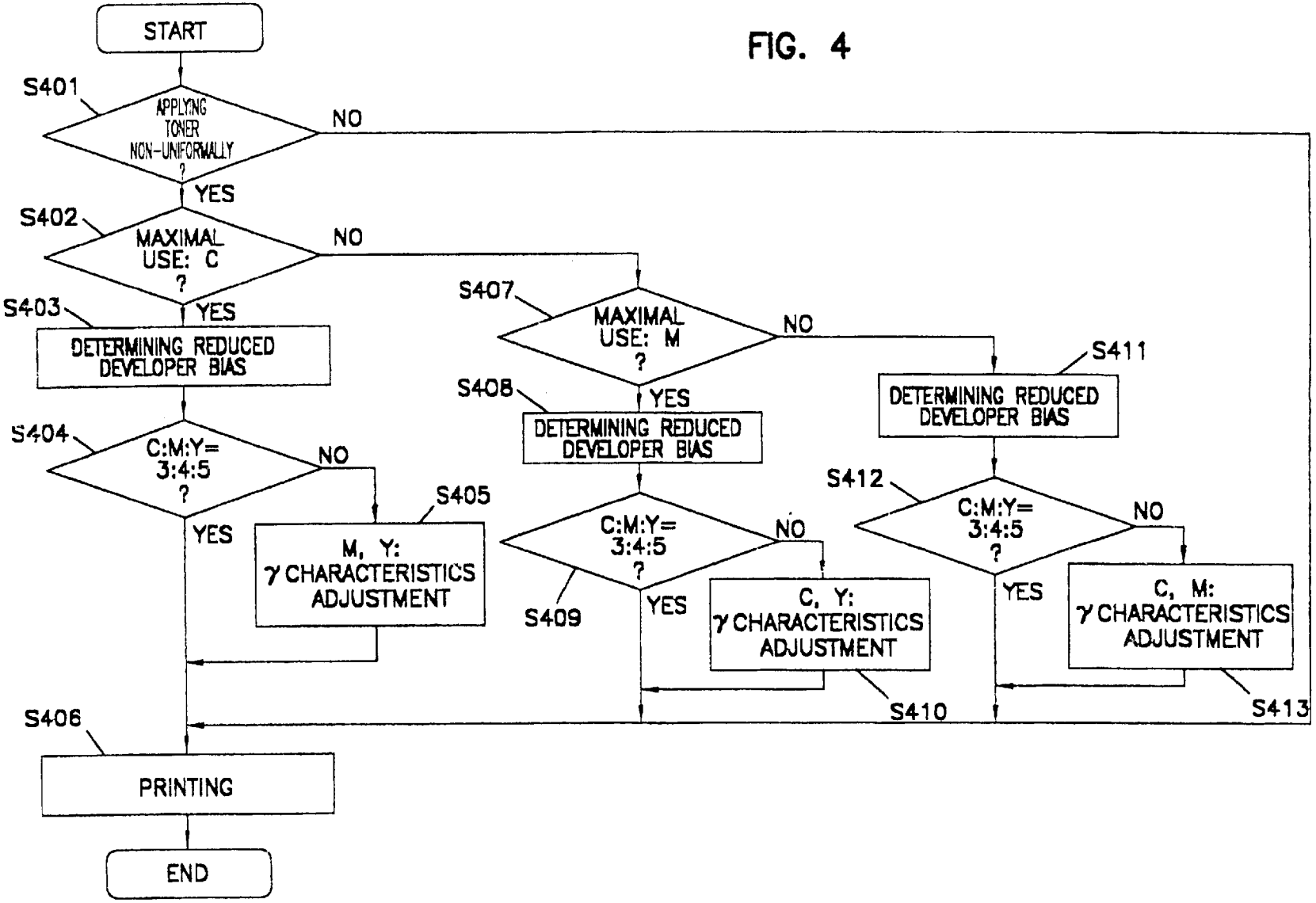
FIG. 4 is a flow chart illustrating steps or acts involved in a second preferred process of printing according to the current invention.

Now referring to FIG. 4, a flow chart illustrates steps or acts involved in a second preferred process of printing according to the current invention. The second preferred process will be also described with respect to tasks performed by the elements in the second preferred embodiment. In general, the gamma characteristic adjustment is based upon which color component is most consumed for a desired image. Based upon the bit-map image data of a desired image in the RAM106, the controller 200 determines whether or not an amount of toner to be applied is substantially equal among the CMY color components in generating the desired image in step S401. When it is determined that the amounts are not substantially unequal, the second preferred process proceeds to a step S406, where the print engine 208 prints the image data and the preferred process terminates processing. On the other hand, when it is determined that the amounts are substantially unequal, the second preferred process proceeds to a step S402, where the controller 200 determines which one of the CMY color components has the largest amount of toner to be applied in generating the desired image.

Still referring to FIG. 4, the gamma characteristic adjustment is performed based upon the largest color component consumption. In case the C color component toner is to be applied in the largest amount, the controller 200 lowers the developing bias voltage value of the print engine in a step S403. It is further decided in a step S404 whether or not a predetermined toner application level ratio will be maintained so that color balance is achieved in the output image. In this implementation of the preferred process, the predetermined toner application level ratio is 3:4:5 among the CMY color components. If the toner application level ratio is maintained, the preferred process proceeds to the printing process at the step S406. On the other hand, the toner application level ratio is not the predetermined ratio, gamma characteristics of M and Y color components are adjusted in a step S405 to achieve the predetermined ratio before proceeding to the step S406. Similarly, in case the M color component toner is to be applied in the largest amount, the controller 200 lowers the developing bias voltage value of the print engine in a step S408. It is further decided in a step S409 whether or not the predetermined toner application level ratio will be maintained so that color balance is achieved in the output image. If the toner application level ratio is maintained, the preferred process proceeds to the printing process at the step S406. On the other hand, the toner application level ratio is not the predetermined ratio, gamma characteristics of C and Y color components are adjusted in a step S410 to achieve the predetermined ratio before proceeding to the step S406. Lastly, by the process of elimination, in case the Y color component toner is to be applied in the largest amount, the controller 200 lowers the developing bias voltage value of the print engine in a step S411. It is further decided in a step S412 whether or not the predetermined toner application level ratio will be maintained so that color balance is achieved in the output image. If the toner application level ratio is maintained, the preferred process proceeds to the printing process at the step S406. On the other hand, the toner application level ratio is not the predetermined ratio, gamma characteristics of C and M color components are adjusted in a step S413 to achieve the predetermined ratio before proceeding to the step S406.

The second preferred process has variations. Although the above second preferred process was described with respect to the three color components, other implementations of the second preferred process is not limited to the three color components. In other implementations, using the bit-map image data, the controller 200 determines the largest amount of toner based upon the intensity of the color components in comparison to a predetermined threshold value. For example, to determine a color component, the predetermined threshold for intensity is 75% of the max or 100% intensity. Another implementation combines two criteria. The largest toner consumption is first determined, and then the determined color component is compared to the predetermined intensity threshold value in order to enter into a toner save mode. Thus, the largest amount of toner consumption alone fails to invoke the toner save mode in generating the output image unless the intensity of the same color component has exceeded the predetermined intensity value. In addition, separate intensity and usage threshold values are used for color components. For example, the process enters the toner save mode if the C color component uses less than 40% of the total toner consumption and the total C color component intensity is over 90% of the max intensity. Another example is that the process enters the toner save mode if the C color component uses more than 80% of the total toner consumption and the total C color component intensity is over 70% of the max intensity. Additionally, the amount of inequality among the color component consumptions is optionally determined to invoke the toner save mode. As illustrated in the above examples, color balance is achieved more effectively during the toner save mode based upon the most consumed toner color component. At the same time, by reducing the developing bias voltage, the consumption of the most consumed toner color component can be reduced and the color components are potentially consumed in a more equal manner.

Figure 5:
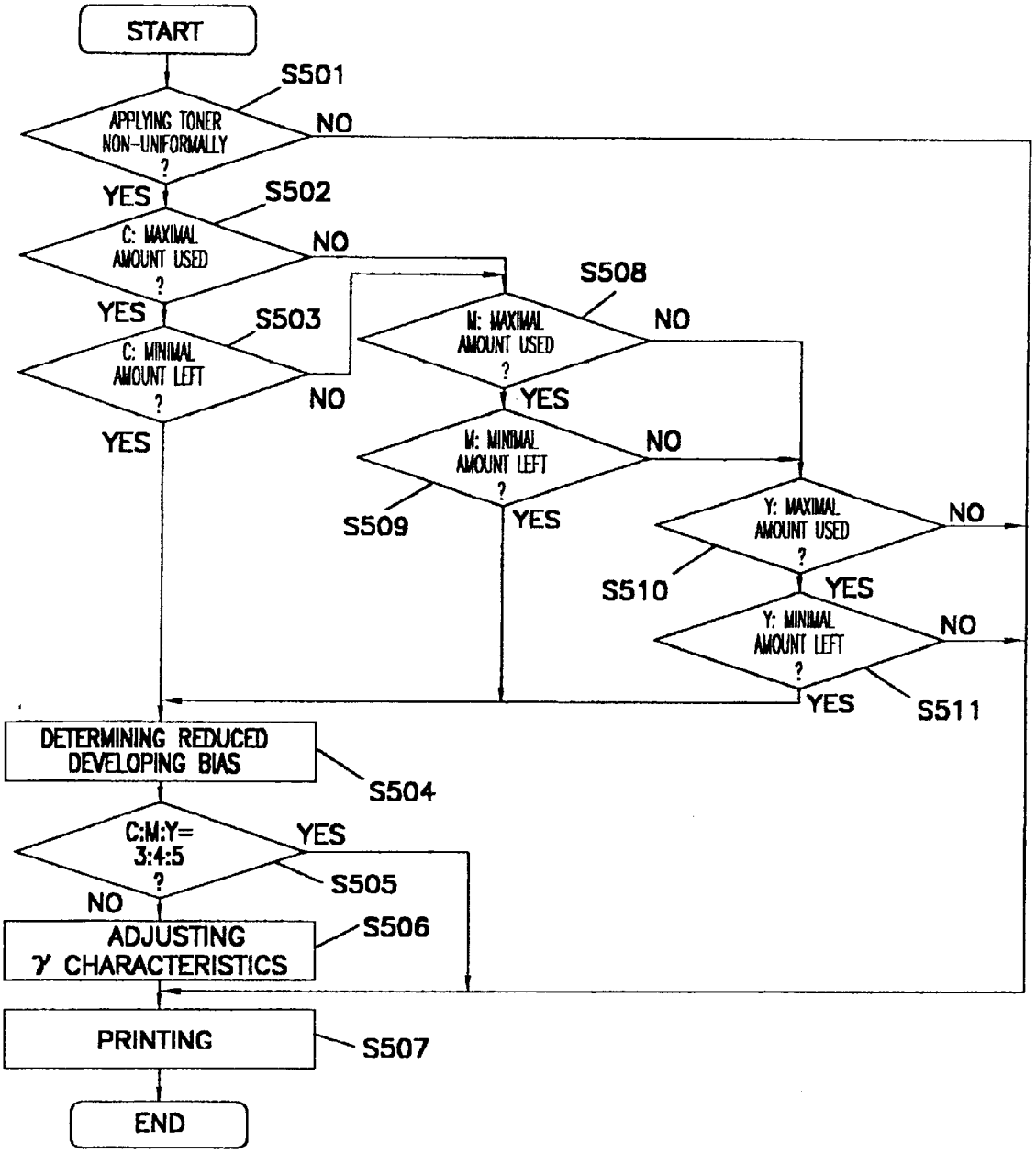
FIG. 5 is a flow chart illustrates steps or acts involved in a third preferred process of printing according to the current invention.

Now referring to FIG. 5, a flow chart illustrates steps or acts involved in a third preferred process of printing according to the current invention. The third preferred process will be also described with respect to tasks performed by the elements in the second preferred embodiment. In general, the gamma characteristic adjustment is performed based upon the measurements of remaining toner amount and the relative toner consumption. Based upon the bit-map image data of a desired image in the RAM 106, the controller 200 determines whether or not an amount of toner to be applied is substantially equal among the CMY color components in generating the desired image in step S501. When it is determined that the amounts are not substantially unequal, the third preferred process proceeds to a step S507, where the print engine 208 prints the image data and the preferred process terminates processing. On the other hand, when it is determined that the amounts are substantially unequal, the third preferred process proceeds to a step S502, where the controller 200 determines whether or not the C color component has a relatively large amount of toner to be applied in generating the desired image. The relative determination is made based upon a predetermined absolute value or a predetermined relative percentage consumption value.

Still referring to FIG. 5, the gamma characteristic adjustment is performed based upon the color component consumption. In case the C color component toner is to be applied in the large amount, the controller 200 further determines in a step 503 whether or not the remaining amount of the C toner is a relatively small amount based upon a measurement of the toner amounts from the toner sensor 213. The small amount is either relative or absolute. For example, the measured remaining amount is compared to a predetermined threshold value stored in the NVRAM 103. When it is determined that the C remaining amount is relatively small in the step 503, the controller 200 lowers the developing bias voltage value of the print engine 208 in a step S504. When the determination is negative in either one of the steps 502 or 503, the preferred process proceeds to a step 508, where it is determined whether or not the M color component toner is to be applied in a relatively large amount. In case the M color component toner is to be applied in the large amount, the controller 200 further determines in a step 509 whether or not the remaining amount of the M toner is a relatively small amount based upon a measurement of the toner amounts from the toner sensor 213. If the results of the steps 508 and 509 are both affirmative, the preferred process proceeds to the step 504. On the other hand, either result of the steps 508 or 509 is negative, the preferred process proceeds to the step S510, where it is determined whether or not the Y color component toner is to be applied in a relatively large amount. In case the Y color component toner is to be applied in the large amount, the controller 200 further determines in a step 511 whether or not the remaining amount of the Y toner is a relatively small amount based upon a measurement of the toner amounts from the toner sensor 213. If the results of the steps 510 and 511 are both affirmative, the preferred process proceeds to the step 504. On the other hand, either result of the steps 510 or 511 is negative, the preferred process proceeds to the step S507, and the print engine prints an output image without lowering the developing bias voltage.

Based upon the affirmative result of the steps 503, 509 or 511, the controller 200 lowers the developing bias voltage value. It is further decided in a step S505 whether or not a predetermined toner application level ratio will be maintained so that color balance is achieved in the output image. In this implementation of the preferred process, the predetermined toner application level ratio is 3:4:5 among the CMY color components. If the toner application level ratio is maintained, the preferred process proceeds to the printing process at the step S507. On the other hand, the toner application level ratio is not the predetermined ratio, gamma characteristics of the CMY color components are adjusted in a step S506 to achieve the predetermined ratio before proceeding to the step S507.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of saving toner in image duplicating devices, toner having color components, comprising:

selecting a reduced toner application level that is below a predetermined application level, the predetermined application level including information on a ratio of application levels of the toner color components, the ratio defining a toner application level ratio;

determining a reduced toner application level ratio according to the selected reduced toner application level;

adjusting the reduced toner application level ratio; and applying the toner based upon the adjusted toner application level ratio so as to generate a desired image and maintain a consistent appearance of color image.

2. The method of saving toner in image duplicating devices according to claim 1 wherein the reduced toner application level is selected from predetermined toner application levels.

3. The method of saving toner in image duplicating devices according to claim 1 further comprising monitoring the applied toner and further adjusting the reduced toner application level ratio based upon the monitoring of the applied toner.

4. The method of saving toner in image duplicating devices according to claim 1 wherein said adjusting is based upon a predetermined gamma correction curve.

5. The method of saving toner in image duplicating devices according to claim 1 further comprising determining the application levels are equal among the toner color components.

6. The method of saving toner in image duplicating devices according to claim 1 further comprising determining which one of the toner color components is consumed most, wherein a reduced ratio corresponding to the most consumed toner color component is determined based upon the reduced toner application level ratio.

7. The method of saving toner in image duplicating devices according to claim 6 further comprising determining whether or not a remaining amount of the most consumed toner color component is below a predetermined threshold amount.

8. A system for saving toner in image duplicating devices, toner having color components, comprising:

an input unit for selecting a reduced toner application level that is below a predetermined application level, the predetermined application level including information on a ratio of application levels of the toner color components, the ratio defining a toner application level ratio;

a processing unit connected to said input unit for determining a reduced toner application level ratio according to the selected reduced toner application level, said processing unit adjusting the reduced toner application level ratio; and an image generation unit connected to said processing unit for applying the toner based upon the adjusted toner application level ratio so as to generate a desired image and maintain a consistent appearance of color image.

9. The system for saving toner in image duplicating devices according to claim 8 wherein said input unit displays predetermined toner application levels and selects one of the predetermined toner application levels.

10. The system for saving toner in image duplicating devices according to claim 8 further comprising a monitoring unit for monitoring the applied toner, said processing unit further adjusting the reduced toner application level ratio based upon a monitored result of the applied toner.

11. The system for saving toner in image duplicating devices according to claim 8 wherein said processing unit adjusts the reduced toner application level ratio based upon a predetermined gamma correction curve.

12. The system for saving toner in image duplicating devices according to claim 8 wherein said processing unit further determines whether or not the application levels are equal among the toner color components.

13. The system for saving toner in image duplicating devices according to claim 8 wherein said processing unit further determines which one of the toner color components is consumed most, wherein said processing unit determines a reduced ratio corresponding to the most consumed toner color component based upon the reduced toner application level ratio.

14. The system for saving toner in image duplicating devices according to claim 13 further comprising a remaining sensor unit for determining whether or not a remaining amount of the most consumed toner color component is below a predetermined threshold amount.

* * * * *